US006961024B1

(12) United States Patent
Zheludev et al.

(10) Patent No.: US 6,961,024 B1
(45) Date of Patent: Nov. 1, 2005

(54) TRANSMITTING AND RECEIVING APPARATUS

(76) Inventors: Nikolay Zheludev, 50 Basset Crescent West, Southampton SO16 7DX (GB); Boris I. Kokorin, Old Arabat, 33 Sivtev Vrajek Pereuiok, Apartment 10, 4th Floor, Moscow (RU)

( * ) Notice: Subject to any disclaimer, the term of this patent is extended or adjusted under 35 U.S.C. 154(b) by 0 days.

(21) Appl. No.: 09/937,736

(22) PCT Filed: Mar. 29, 2000 (Under 37 CFR 1.47)

(86) PCT No.: PCT/GB00/01199

§ 371 (c)(1), (2), (4) Date: May 30, 2003

(87) PCT Pub. No.: WO00/59069

PCT Pub. Date: Oct. 5, 2000

(30) Foreign Application Priority Data

Mar. 29, 1999 (GB) ..... 9907253

(51) Int. Cl.[7] ..... H01Q 11/12

(52) U.S. Cl. ..... 343/742; 343/744; 343/866

(58) Field of Search ..... 343/742, 743, 343/744, 746, 748, 866, 867, 895, 788

(56) References Cited

U.S. PATENT DOCUMENTS 6,552,530 B1 * 4/2003 Vaiser et al. ..... 324/204

* cited by examiner

*Primary Examiner*—Hoang V. Nguyen
(74) *Attorney, Agent, or Firm*—Westman, Champlin & Kelly

(57) ABSTRACT

An antenna for transmitting information by means of electromagnetic fields in free space is formed as a supertoroidal conductor, comprising a helical coil of wire with the coil itself being wound helically around a toroidal former to form a toroidally shaped coiled coil. Higher orders of supertoroid are formed by replacing the wire of the above first order supertoroidal conductor with a helical coil. The supertoroidal antenna is energized from a signal generator generating signals including frequencies not less than 2 c/l, where l is the length of conductor in the supertoroidal antenna. Both transmitting and receiving arrangements are disclosed.

2 Claims, 6 Drawing Sheets

FIG. 4. STA order 2 EMISSION EFFICIENCY FOR 2 ORIENTATIONS + EMISSION EFFICIENCY FOR A COMMERCIAL SPIRAL LOG ANTENNA FIG. 5. STA order-3 EMISSION EFFICIENCY FOR 2 ORIENTATIONS + EMISSION EFFICIENCY FOR A COMMERCIAL SPIRAL LOG ANTENNA

TRANSMITTING AND RECEIVING APPARATUS

This application is a national stage filing under 35 U.S.C. § 371 and priority is hereby claimed on International Application No. PCT/GB00/01199, filed Mar. 29, 2000, which International Application was published in English as No. WO 00/59069.

The present invention relates to transmitting and receiving apparatus and particularly to apparatus for transmitting information by means of electromagnetic fields in free space and for receiving such information.

Radio frequency transmitters and receivers employ a wide range of antenna types. Different types of antenna may be used depending on the requirements of the transmitting and receiving system. For example, line of sight transmission between two fixed points may employ narrow beam transmitting and receiving antennae, such as dish antennae (for UHF and microwave frequencies), and multi element arrays for UHF and lower frequencies. In other applications, omni-directional antennae are required, for example for mobile communications and for radio positioning systems using fixed beacons.

There is also a requirement in some systems for antennae to be operable over a relatively broad band of frequencies. Apart from military applications generally, there are increasing applications for spread spectrum transmission systems for which wide band antennae may be highly desirable.

A further requirement of antennae systems, especially those which are required to be portable, is that they be as small and compact as possible.

U.S. Pat. No. 5,734,353 discloses a contra wound toroidal helical antenna made from a single continuous conductor divided into two length portions each of which are substantially the same length and which have a generalised helical pattern. The helical pitch senses in the two length portions are opposite one another. The two length portions are insulated from one another and overlap one another on the surface of a generalised toroid former. The antenna is said to have vertical polarisation with a radiation pattern similar to an electric dipole, but in a physical package that is substantially smaller.

According to the disclosure, the antenna is intended to operate with a moderate band width (10 to 20%) around a resonant frequency. The resonant frequency is determined in relation to the geometry of the toroidal conductor so chat the circumferential length of the toroidal helical antenna is one half of a guided wavelength. From the examples given in this patent specification, a toroidal helical antenna with a total helical conductor length of about 3 meters has a resonant frequency of operation at around 30 MHZ.

At such a frequency, the toroidal antenna would have a major diameter of about 50 cms. Higher operating frequencies would employ a antenna of smaller diameter and vice versa.

Similar contra wound toroidal helical antenna structures are disclosed in U.S. Pat. Nos. 5,654,723, 5,442,369; 4,751,515 and 4,622,558.

The present invention provides apparatus for transmitting information by means of electromagnetic fields in free space comprising an antenna in the form of a super-toroidal conductor including a length of conductor 1, an electrical signal generator controllable to produce electrical signals having at least a selected frequency which is not less than 2 c/l where c is the speed of light in free space, a coupler to couple said electrical signals from said generator to energise said antenna for launching the electromagnetic fields to transmit the information, and a modulator to modulate the electromagnetic fields launched by the antenna in accordance with the information to be transmitted.

Whilst a toroidal helical conductor, as known in the aforementioned prior art specifications, is one in which the conductor is wound helically around a toroidal former, a super-toroidal conductor is one in which the windings of a toroidal helical conductor are themselves constituted as helical windings. In a first order super-toroidal winding, the conductor of the toroidal helical winding of the prior art is replaced by a long helically coiled conductor which is itself wound around the toroidal former. In a second order super-toroidal winding, the conductor of the first order super-toroidal winding is replaced by a long helically coiled conductor, and so forth up to higher orders. All references herein to windings being helical in form should be construed as references also to other windings providing a generally poloidal form.

Energising an antenna in the form of a super-toroidal conductor as set out above, at the relatively high frequencies specified, has been found to provide surprising and useful results in the field of the transmission of information by electromagnetic fields. In particular, when energised at the higher frequencies indicated, the antenna has been found to have extremely broad band characteristics, extending over at least one doubling of frequency. Furthermore, an antenna in the form of a super-toroidal conductor energised as indicated is not only omni-directional in an azimuthal plane parallel to the plane of the torus, but also provides substantial emission in directions parallel to the major axis of the torus, i.e. perpendicular to the azimuthal plane.

The invention also provides apparatus for receiving information transmitted by means of electromagnetic fields in free space from a distant source, the apparatus comprising an antenna in the form of a super-toroidal conductor having a length of conductor 1, a receiver controllable to receive electrical signals having at least a selected frequency which is not less than 2 c/l where c is the speed of light in free space, a coupler to couple, from the antenna to the receiver, electrical signals produced in the antenna due to information with electromagnetic fields carrying the transmitted information, and a detector for detecting the information from the electrical signals.

Examples of the invention will now be described with reference to the accompanying drawings in which:

FIGS. 1*a* and 1*b* are schematic views of a super-toroidal conductor winding in the plane of the torus, and along the major axis of the torus respectively;

Super-toroidally wound conductors have been described in WO 95/03850. This specification discloses super-toroidal windings of various orders including second and third order windings, in applications for detecting and generating forms of electromagnetic field associated with living organisms and non-living bodies, and also for producing fields for treating such organisms and bodies. Although the specification refers to the super-toroidal windings as "aerials" in fact the specification nowhere contemplates using such devices for the transmission or reception of information by modulating information at a transmitter and by detecting the transmitted information at a receiver.

Figure 1A:
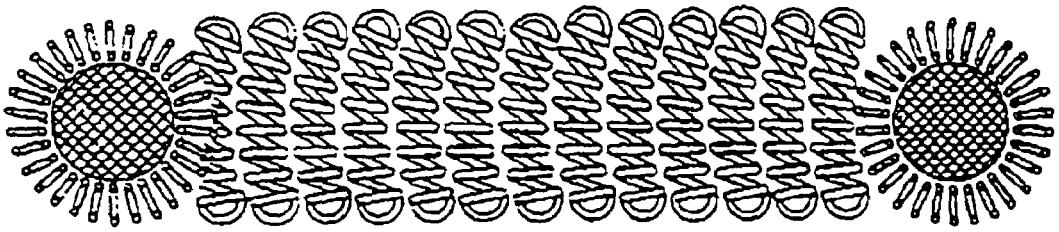
Figure 1B:
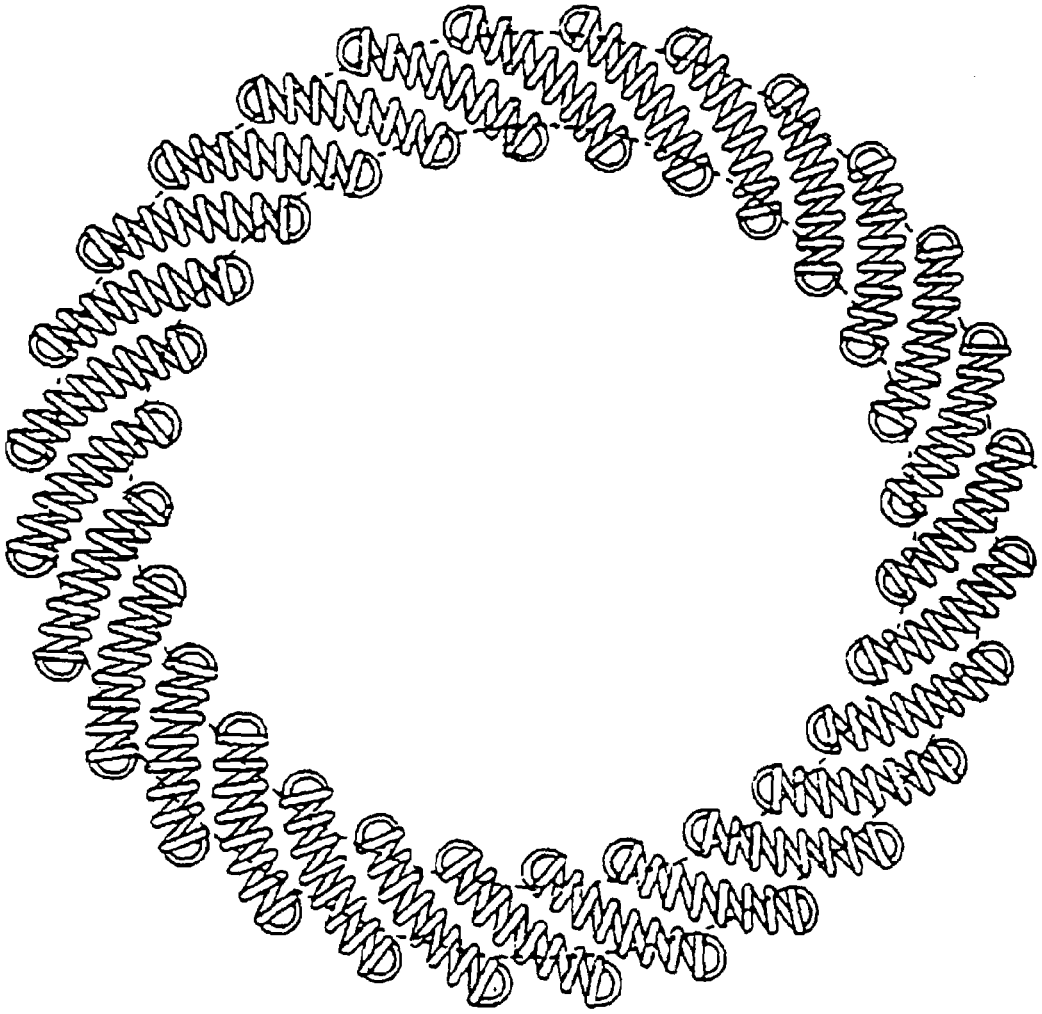
Figure 2:
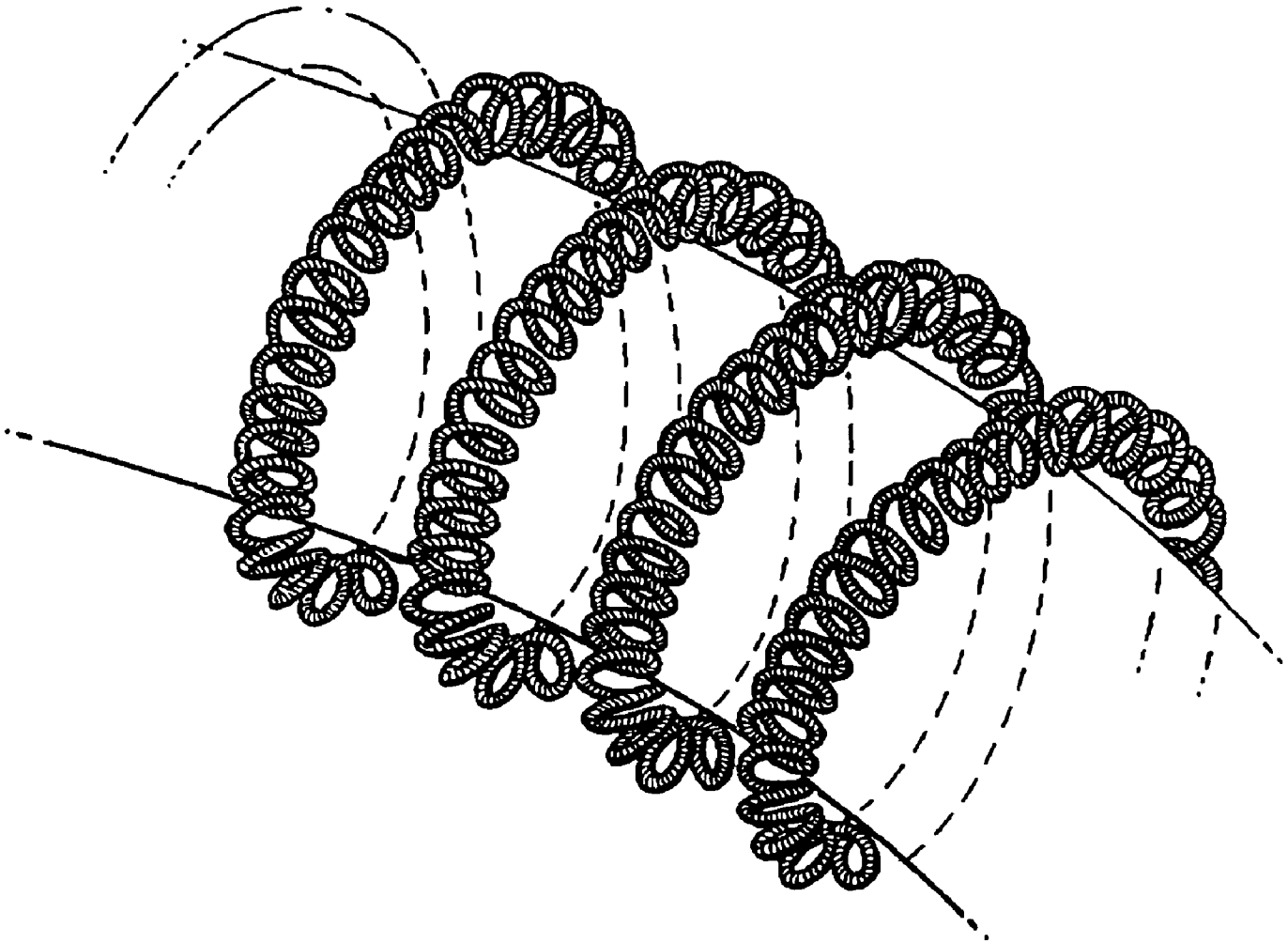
FIG. 2 is a view of part of the torus of the winding of FIG. 1 illustrating a super-toroid of second order.
Figure 3:
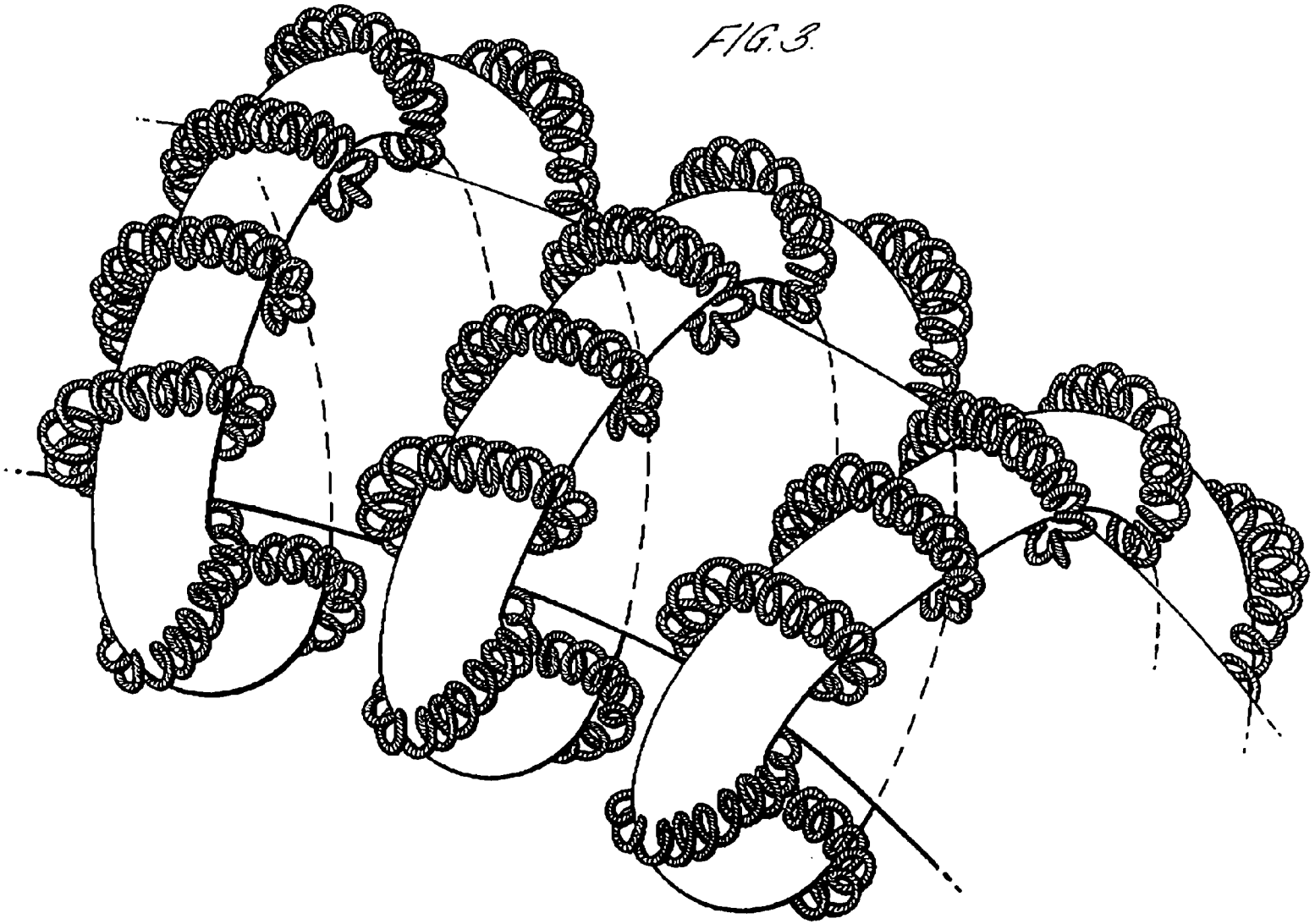
FIG. 3 is a view of part of the torus of a super-toroidal winding of third order.
Figure 6:
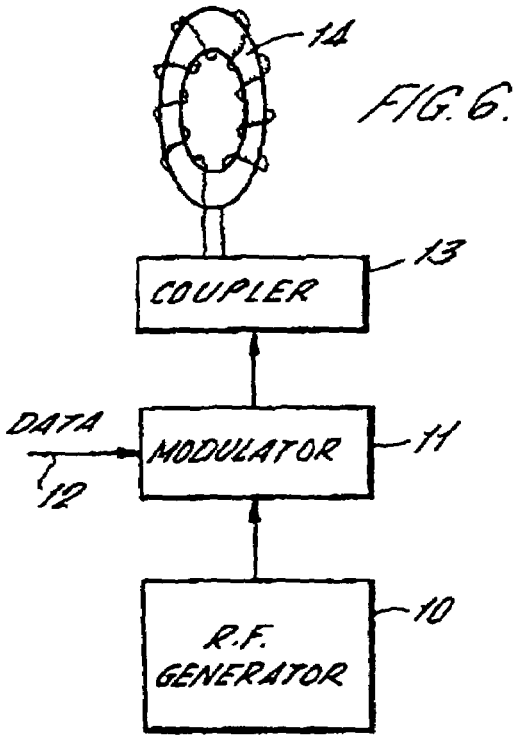
FIG. 6 is a block schematic diagram illustrating a transmitter embodying the present invention.

In accordance with an embodiment of the present invention, a second order super-toroidal conductor as illustrated in FIGS. 1 and 2 is used as the transmitting antenna of a radio transmitter for sending information to a remote receiver. Referring to FIG. 6, the transmitter may comprise an rf generator or a pulse generator 10 supplying radio frequency signals or electric pulse signals to a modulator 11. The modulator 11 modulates or transforms the signals from the generator 10 in accordance with data to be transmitted supplied to the modulator on line 12. The modulated or transformed signals are then supplied by means of a coupler 13 to energise the super-toroidal antenna 14.

In accordance with a feature of the present invention, the transmitter using the super-toroidal antenna 14 is arranged to energise the antenna 14 at frequencies substantially above those frequencies at which the current in all segments of the super-toroidal winding of the antenna 14 would have substantially the same phase. It may be understood that prior art toroidal helical antennae have been energised at frequencies such that the magnetic field induced around the circumference of the torus at any instant in time has the same direction around the torus at all points around the torus. This is necessary if the prior art toroidal helical antennae are to substantially reproduce the effect of a linear electric dipole. In accordance with the embodiment of the present invention, the rf generator 10 is arranged to produce radio frequency signals at frequencies substantially higher than those which could produce a uniform circumferential magnetic field around the torus at any time.

It has been found that at such higher frequencies, the super-toroidal antenna embodying the present invention has very broad band attributes. In addition, the antenna is not only omni-directional in the azimuthal plane of the torus of the antenna, but produces substantial transmission in directions parallel to the major axis of the torus.

An appropriate lower limit for the frequency of signals to be supplied to the super-toroidal antenna of FIG. 6 is the frequency at which the wavelength in free space of electromagnetic radiation would be half the total length of the conductor forming the super-toroidal antenna. In one example, a first order super-toroidal antenna has a conductor length of 20 meters. The operating frequency range preferably has a lower limit of 30 MHZ, and preferably extends to several hundreds of MHZ, and even to several GHZ.

If the antenna 14 is formed of a second order super-toroidal winding, the wire length is typically 84 meters, implying a lower frequency limit of about 7 MHZ. A third order super-toroidal antenna having a conductor length of 210 meters could be used down to about 2.8 MHZ.

Figure 7:
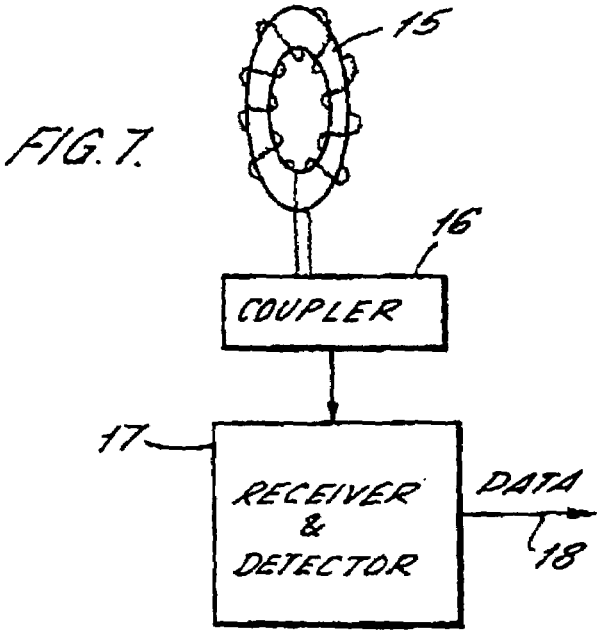
FIG. 7 is a block schematic diagram illustrating a receiver embodying the present invention.

FIG. 7 illustrates a receiver embodying the present invention. In FIG. 7, electromagnetic fields modulated with information from a remote source interact with a super-toroidal antenna 15 which is connected via a coupler 16 to a receiver and detector circuit 17. The receiver 17 is adapted to receive signals from the antenna 15 at frequencies higher than frequencies corresponding to a free space wavelength of half the conductor length of a super-toroidal antenna 15. The detector in the receiver and detector circuit 17 is arranged to detect modulation of the received signals so as to derive from the received signals the data being transmitted from the remote source and supply this data on an output line 18.

Figure 4:
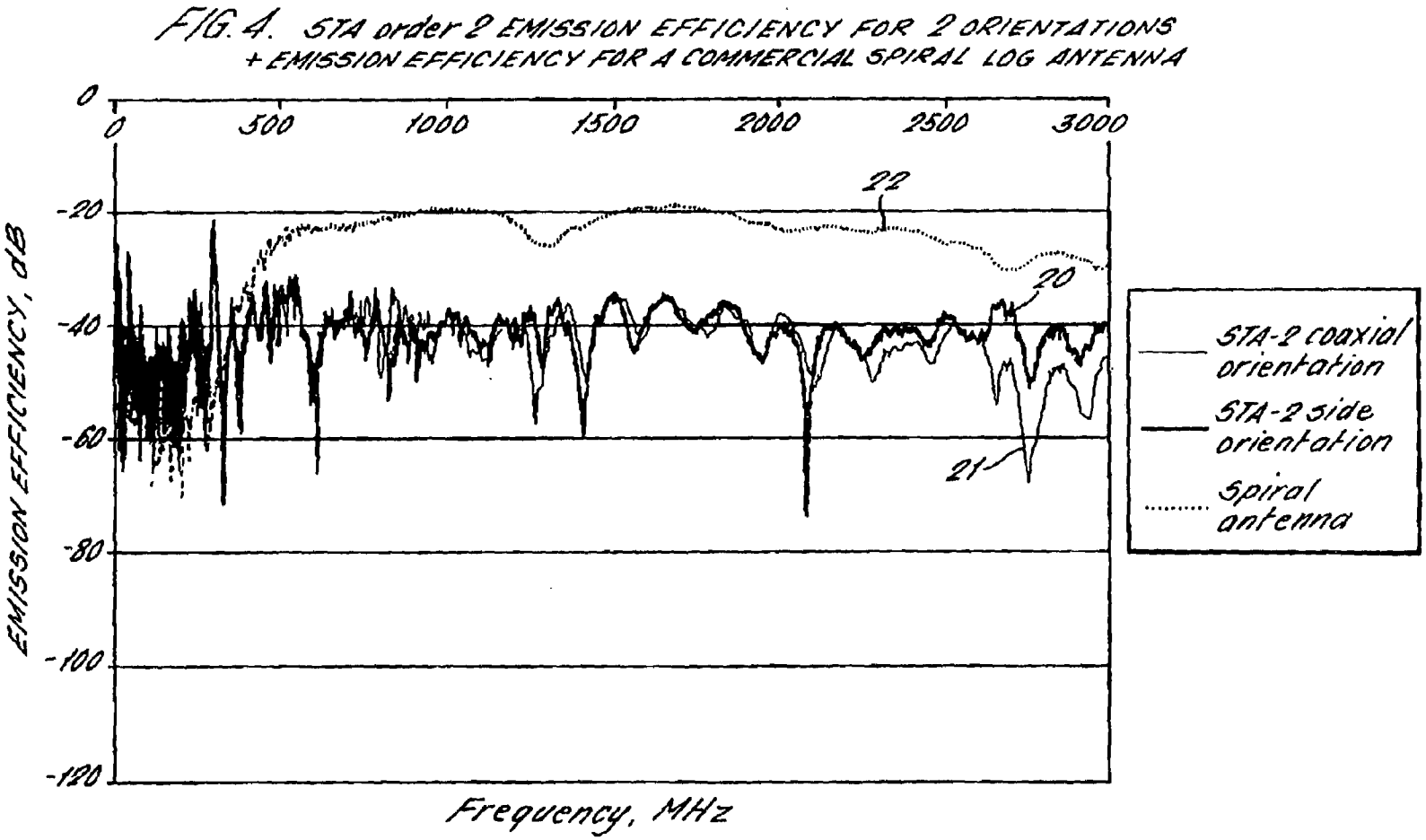
FIG. 4 is a graphical plot illustrating the emission efficiency of a super-toroidal antenna of second order.

FIG. 4 illustrates the performance of a second order super-toroidal antenna in various orientations.

In FIG. 4, the heavy line 20 is a plot of the emission efficiency of the second order super-toroidal antenna in directions parallel to the plane of the torus of the antenna, over frequencies ranging from zero to several GHZ. The fine solid line 21 in the Figure is a plot of the emission efficiency of the antenna in directions parallel to the major axis of the torus of the antenna. A further plot 22 of the emission efficiency of a commercial spiral log antenna is provided for comparison purposes.

Figure 5:
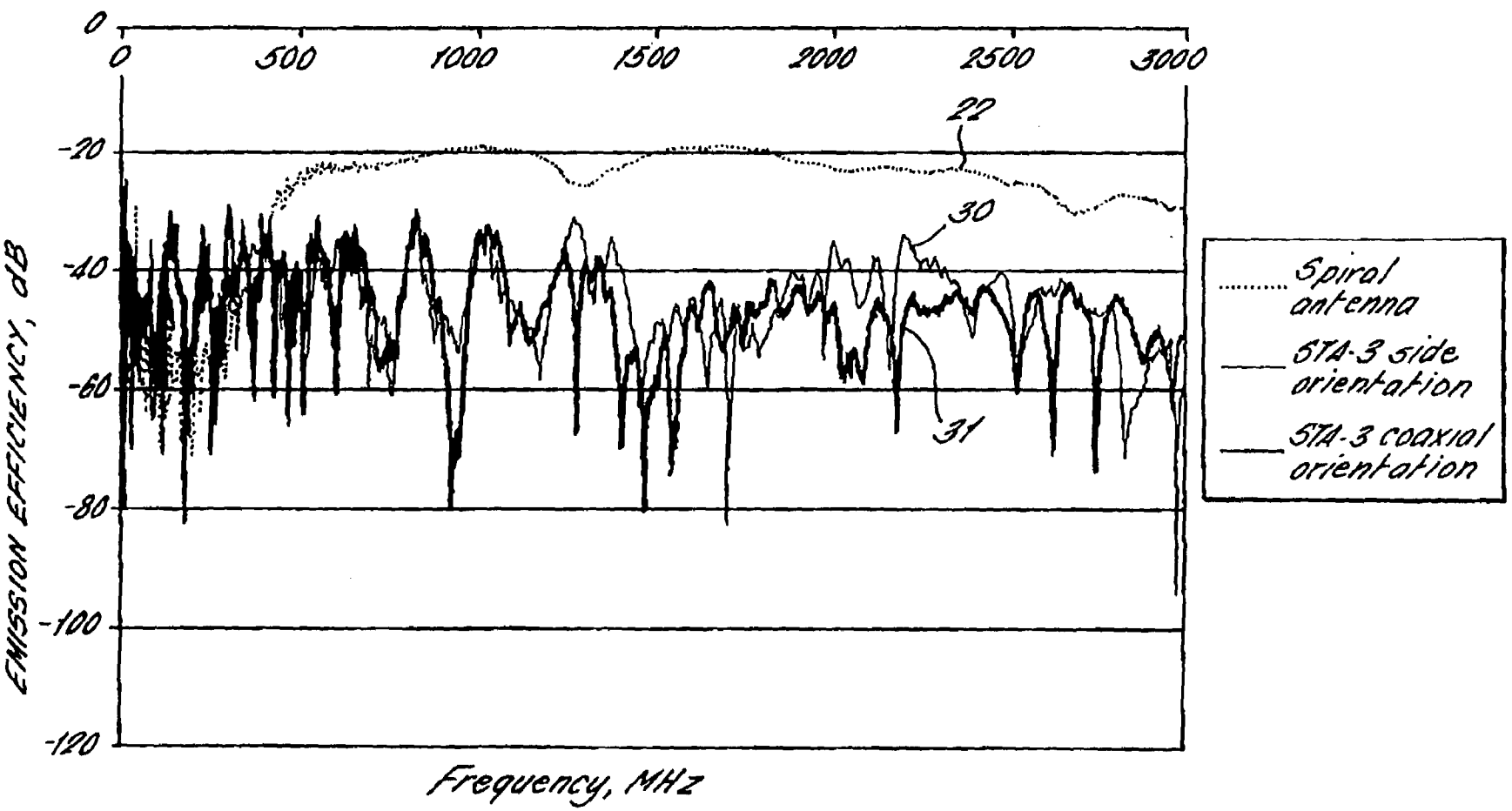
FIG. 5 is a graphical plot illustrating the emission efficiency of a super-toroidal antenna of third order.

FIG. 5 illustrates the emission efficiency with frequency of a third order super-toroidal antenna. In this Figure, the fine solid line 30 plots the emission efficiency of the antenna in directions parallel to the plane of the torus, and the heavy line 31 plots the emission efficiency in directions parallel to the major axis of the torus.

In FIG. 6, the super-toroidal antenna 14 is illustrated as coupled by direct connection to opposite ends of the conductor forming the super-toroidal winding of the antenna. Other forms of coupling to the transmitting or receiving antennas can be contemplated. For example connections may be made at multiple points around the torus of the winding. Alternatively, the windings may be energised capacitively by plates located close to the windings at different points around the torus. Different coupling arrangements may be preferred for matching the impedance of the antenna to the feeding or receiving circuitry as appropriate.

Rather than a continuous helix, the winding of the antenna may be formed in sections which may be connected together or separately energised. The winding may also be formed using double or multiple conductors, possibly wound with opposite hand.

It should be understood that the torus used as the former of the antenna need not be a body of revolution and is not necessary circular in radial section, but has generally toroidal topology.

Further the helicity of the winding of the antenna may have different sign at different levels of the super-toroidal structure, and/or different sign in different sections of the same level. Clearly, the windings illustrated in the Figures are only examples.

What is claimed is:

1. Apparatus for transmitting information by means of radiated electromagnetic fields in free space for reception of the information by a receiver at a remote location, the apparatus comprising an antenna in the form of a super-toroidal conductor having a conductor length l, an electrical signal generator controllable to produce electrical signals having at least one frequency component which is not less than 2 c/l where c is the speed of light in free space, a modulator to modulate said electric signals in accordance with the information to be transmitted, a coupler to couple said modulated electrical signals from said generator to energize said antenna at the frequency of said component which is substantially above frequencies at which the current in all segments of the super-toroidal conductor can be in phase, whereby electromagnetic fields are launched by the antenna to transmit the information.

2. Apparatus for receiving information transmitted by means of radiated electromagnetic fields in free space from a distant transmitter, the apparatus comprising an antenna in the form of a super-torodial conductor having a conductor length l, a receiver arranged to receive electrical signals having at least one frequency component which is not less than 2 c/l where c is the speed of light in free space, a coupler to couple, from the antenna to the receiver, electrical signals produced in the antenna due to interaction with electromagnetic fields having said frequency component and carrying the transmitted information wherein the frequency of said component is substantially above frequencies at which the current in all segments of the super-toroidal conductor can be in phase, and a detector for detecting the information from the received electrical signals.

* * * * *